US008629829B2

(12) United States Patent
Chen et al.

(10) Patent No.: US 8,629,829 B2
(45) Date of Patent: Jan. 14, 2014

(54) PROCESSING DEVICE AND PROCESSING METHOD FOR HIGH DYNAMIC CONTRAST OF LIQUID CRYSTAL DISPLAY DEVICE

(75) Inventors: Ming Chen, Beijing (CN); Xinshe Yin, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 580 days.

(21) Appl. No.: 12/061,392

(22) Filed: Apr. 2, 2008

(65) Prior Publication Data

US 2008/0266331 A1 Oct. 30, 2008

(30) Foreign Application Priority Data

Apr. 24, 2007 (CN) ..... 2007 1 0098664

(51) Int. Cl.
*G09G 5/10* (2006.01)

(52) U.S. Cl.
USPC ..... 345/102; 345/690

(58) Field of Classification Search
USPC ..... 345/87, 98–100, 102, 204, 690
See application file for complete search history.

(56) References Cited

U.S. PATENT DOCUMENTS

| | | | | |
|---|---|---|---|---|
| 6,480,180 | B1 | 11/2002 | Moon | |
| 7,443,377 | B2 | 10/2008 | Kim | |
| 8,013,830 | B2 | 9/2011 | Hsu et al. | |
| 2002/0011979 | A1* | 1/2002 | Nitta et al. | 345/89 |
| 2002/0163490 | A1* | 11/2002 | Nose | 345/89 |
| 2004/0257329 | A1 | 12/2004 | Park et al. | |
| 2005/0001801 | A1 | 1/2005 | Kim | |
| 2005/0104837 | A1 | 5/2005 | Baik et al. | |
| 2005/0104839 | A1 | 5/2005 | Baik | |
| 2005/0104840 | A1 | 5/2005 | Sohn et al. | |
| 2005/0140640 | A1 | 6/2005 | Oh et al. | |
| 2006/0055660 | A1* | 3/2006 | Teranishi | 345/102 |

(Continued)

FOREIGN PATENT DOCUMENTS

| | | |
|---|---|---|
| CN | 1661663 | 8/2005 |
| CN | 1912963 | 2/2007 |

(Continued)

OTHER PUBLICATIONS

Park et al., Machine translation of Korean Unexamined Patent Application No. 10-2003-0040127, Published Jul. 2, 2004.*

(Continued)

*Primary Examiner* — Regina Liang
(74) *Attorney, Agent, or Firm* — Ladas & Parry LLP

(57) ABSTRACT

The present invention relates to a processing device and processing method for high dynamic contrast of a liquid crystal display. The processing device comprises a receiver, an inverter and a source driver integrated circuit connected to a center processing module. The processing method comprises: performing a histogram-statistical processing on a received low-voltage differential signal data; obtaining a backlight source luminance control parameter and a gamma reference voltage parameter of the same frame of picture according to the result of the histogram-statistical processing; controlling the luminance of the backlight source according to the backlight source luminance control parameter; and controlling the voltage of a pixel capacitor on the liquid crystal panel according to the gamma reference voltage parameter. The present invention adjusts the luminance of the backlight source and the gamma reference voltage of the liquid crystal panel respectively, whereby enhancing the dynamic contrast of pictures, improving the LCD in terms of the low contrast and flicker, and saving the power consumption of the backlight source.

10 Claims, 3 Drawing Sheets

(56) References Cited

U.S. PATENT DOCUMENTS

| | | | | |
|---|---|---|---|---|
| 2006/0119613 | A1* | 6/2006 | Kerofsky | 345/590 |
| 2006/0125812 | A1 | 6/2006 | Lee | |
| 2006/0209005 | A1* | 9/2006 | Pedram et al. | 345/102 |
| 2006/0221046 | A1 | 10/2006 | Sato et al. | |
| 2007/0097069 | A1 | 5/2007 | Kurokawa et al. | |
| 2007/0176879 | A1 | 8/2007 | Makino et al. | |
| 2008/0068328 | A1 | 3/2008 | Jou et al. | |
| 2008/0117162 | A1 | 5/2008 | Song et al. | |
| 2008/0238856 | A1 | 10/2008 | Bhowmik et al. | |
| 2009/0066632 | A1* | 3/2009 | Chen | 345/102 |
| 2009/0079688 | A1* | 3/2009 | Chen et al. | 345/102 |

FOREIGN PATENT DOCUMENTS

| | | | |
|---|---|---|---|
| CN | 1949353 | | 4/2007 |
| JP | 2002-31846 | | 1/2002 |
| JP | 2005-148709 | A | 6/2005 |
| JP | 2006-154064 | | 6/2006 |
| JP | 2006-276677 | A | 10/2006 |
| JP | 2007-11350 | A | 1/2007 |
| KR | 2004-57882 | | 7/2004 |
| KR | 2007-24185 | | 3/2007 |
| KR | 2007-0094371 | | 9/2007 |
| WO | WO 2006/038253 | A | 4/2006 |

OTHER PUBLICATIONS

Won-Hui Choi, Machine translation of Korean Unexamined Patent Application No. 10-2007-0024185, Published Mar. 2, 2007.*

Zhiyong Wei, "Driving Circuit Design of TFT Liquid Crystal Module," Database for China excellent Dissertation for Doctor and Master Degree, Information Technology Edition, Master Degree Part, Dec. 15, 2006, pp. 15-23 (includes English translation).

Official Action for U.S. Appl. No. 12/128,686, mailed Jan. 3, 2011, 29 pages.

Official Action for U.S. Appl. No. 12/128,686, mailed May 19, 2011, 26 pages.

Official Action for U.S. Appl. No. 12/126,050, mailed Dec. 17, 2010, 23 pages.

Official Action for U.S. Appl. No. 12/126,050, mailed Mar. 30, 2011, 16 pages.

Advisory Action for U.S. Appl. No. 12/126,050, mailed Jun. 13, 2011, 2 pages.

Official Action for U.S. Appl. No. 12/126,050, mailed Jul. 12, 2011, 23 pages.

Official Action for U.S. Appl. No. 12/128,686, mailed Nov. 7, 2011, 31 pages.

Official Action for U.S. Appl. No. 12/126,050, mailed Dec. 29, 2011, 22 pages.

Official Action for U.S. Appl. No. 12/126,050, mailed Jul. 30, 2012, 25 pages.

Official Action for U.S. Appl. No. 12/128,686, mailed Apr. 18, 2012, 24 pages.

Official Action for U.S. Appl. No. 12/128,686, mailed Oct. 3, 2012, 29 pages.

USPTO FOA dated Jan. 30, 2013 in connection with U.S. Appl. No. 12/126,050.

USPTO FOA dated Mar. 28, 2013 in connection with U.S. Appl. No. 12/128,686.

USPTO NOA mailed Oct. 8, 2013 in connection wtih U.S. Appl. No. 12/128,686.

* cited by examiner

PROCESSING DEVICE AND PROCESSING METHOD FOR HIGH DYNAMIC CONTRAST OF LIQUID CRYSTAL DISPLAY DEVICE

FIELD OF THE INVENTION

The present invention relates to a digital image processing device and method of a liquid crystal display (LCD) device, and particularly to a processing device and method for high dynamic contrast of a LCD device.

BACKGROUND OF THE INVENTION

With development of technique and reduction of cost, the Thin Film Transistor (TFT) LCD and TFT liquid crystal television have been replacing the dominant position of conventional CRT in the art of display. As compared to the CRT displays, the TFT LCDs have advantages of low radiation, low power consumption and small volume. However, one defect of the TFT LCDs is relatively lower contrast and luminance. Especially in display of dark pictures, level sense is decreased due to the existence of Gamma curve.

To address this problem, a Dynamic Gamma Control (DGC) solution is proposed in the related art. The main idea of DGC is to increase luminance differences between the gray levels which are dominant in a picture by varying the gamma voltage so that the contrast of the picture is increased. In particular, firstly, a histogram statistics is performed on a Low Voltage Differential Signaling (LVDS) data received by a receiver, and then a gamma reference voltage processing is performed according to the result of the histogram statistics in which the dynamic ranges of gray level voltages having more distribution are widened and the dynamic ranges of gray level voltages having less distribution are narrowed, so that the contrast ratio between the gray levels which are dominant in the picture is enhanced, thereby increasing the contrast of the picture. In practice, the DGC solution has the following problems:

(1) The luminance is increased with increment of the contrast ratio, and the unnecessary luminance increases the power consumption of the backlight source and in turn that of the product; and (2) Human eyes will perceive flicker when continuous pictures show alternation between brightness and darkness or a picture becomes brighter or darker sharply.

SUMMARY OF THE INVENTION

An object of the present invention is to provide a processing device and processing method for high dynamic contrast ratio of a LCD being controlled based on a backlight source, which can improve the dynamic contrast ratio and quality of picture greatly, and remove the technical defects of high power consumption and picture flicker in the related art on the premise of keeping the luminance of the liquid crystal panel unchanged.

To achieve the above objects, there is provided in the present invention a processing device for high dynamic contrast of a liquid crystal display, characterized in comprising: a receiver for receiving a low-voltage differential signal data; a center processing module for performing a histogram-statistical processing on said data, obtaining a backlight source luminance control parameter and a gamma reference voltage parameter of the same frame of picture according to the result of the statistical processing, and generating a pulse-width-modulation dimming control signal and a group of gamma reference voltages; an inverter for receiving the pulse-width-modulation dimming control signal from said center processing module and driving the backlight source; and a source driver integrated circuit for receiving the gamma reference voltages from said center processing module and driving a liquid crystal panel.

The center processing module comprises: a statistical module for receiving the data from the receiver and performing the histogram-statistical processing on the data; an look-up module for receiving the result of the histogram-statistical processing from the statistical module, and obtaining the backlight source luminance control parameter and the gamma reference voltage parameter of the same frame of picture according to the result of the statistical processing; a signal generator for receiving the backlight source luminance control parameter from the look-up module and generating the pulse-width-modulation dimming control signal to be sent to the inverter; a bus controller for receiving the gamma reference voltage parameter from the look-up module and converting the same into a bus format; and a gamma voltage controller for receiving the format-converted gamma reference voltage parameter from the bus controller, and generating the gamma reference voltage to be sent to the source driver integrated circuit.

The look-up module comprises a storage unit storing a lookup table therein which records correspondence of the backlight source luminance and the gamma reference voltage.

Based on the above technical solution, it further comprises: a frame buffer for receiving and storing the low-voltage differential signal subjected to a format-conversion by said receiver; and a transmitter for reading data from the frame buffer and sending the data to the source driver integrated circuit.

To achieve the above object, there is provided in the present invention a processing method for high dynamic contrast of a liquid crystal display comprising: performing a histogram-statistical processing on a received low-voltage differential signal data; obtaining a backlight source luminance control parameter and a gamma reference voltage parameter of the same frame of picture according to the result of the histogram-statistical processing; controlling the luminance of the backlight source according to the backlight source luminance control parameter; and controlling the charging of a pixel capacitor on the liquid crystal panel according to the gamma reference voltage parameter.

The performing of a histogram-statistical processing on the received low-voltage differential signal data comprises: obtaining an amount of pixel counts occupied by each gray level in one frame of picture; determining the gray level which has the greater distribution in the frame of picture according to a threshold; and determining a dimming coefficient according to the gray level which has the greater distribution.

The obtaining of the backlight source luminance control parameter and the gamma reference voltage parameter of the same frame of picture according to the result of the histogram-statistical processing comprises: determining the backlight source luminance control parameter according to the result of the histogram-statistical processing; determining a corresponding gamma voltage parameter according to the dimming coefficient; and obtaining a group of gamma voltages corresponding to the gamma voltage parameter from a lookup table based on the gamma voltage parameter.

The controlling of the luminance of the backlight source according to the backlight source luminance control parameter comprises: generating a pulse-width-modulation dimming control signal from the backlight source luminance control parameter; and driving the backlight source by using the pulse-width-modulation dimming control signal.

The controlling of the voltage of the pixel capacitor on the liquid crystal panel according to the gamma reference voltage parameter comprises: converting the gamma reference voltage parameter into a bus format; generating a group of gamma reference voltages from the gamma reference voltage parameter in the bus format; and driving the liquid crystal panel by using the group of gamma reference voltages.

Based on the above technical solution, it further comprises: buffering the received low-voltage differential signal data; and sending the low-voltage differential signal data to the source driver integrated circuits.

The present invention proposes a processing device and processing method for high dynamic contrast of a LCD being controlled based on a backlight source, which decreases the luminance of picture by decreasing the luminance of the backlight source, varies the transmittance ratio of the liquid crystal panel by adjusting the voltages of the pixel capacitors on the liquid crystal panel to compensate for the distortion caused by the decreasing of the backlight source luminance with the transmittance ratio. Since the present invention concurrently adjusts the luminance of the backlight source and the gamma reference voltage of the liquid crystal panel according to the result of the histogram-statistical processing, thereby increasing the dynamic contrast of pictures and improving the TFT LCDs in terms of the low contrast. The technical solution keeps the luminance of the liquid crystal panel unchanged with modulating the backlight luminance and adjusting the gamma reference voltage, so the problem of flicker is removed. Meanwhile, as the luminance of the backlight source is adjusted by way of external pulse-width-modulation dimming, the power consumption of the backlight source is reduced. Especially in the case where the displayed picture is mostly in the dark state, more power can be saved. The power consumption of the backlight source occupies over 40% of that in the entire LCD device. Such adjusting solution for backlight source luminance of the present invention saves the power consumed by the backlight source, and reduces that of the final product. In addition, the present invention dramatically increases the main parameters of the products, and increases the value of the TFT liquid crystal display device greatly.

Technical solutions of the present invention will be further described in conjunction with the drawings and particular embodiments.

DESCRIPTION OF REFERENCE NUMERALS ARE

10-receiver; 20-statistical module; 30-look-up module; 40-signal controller; 50-inverter; 60-bus controller; 70-gamma voltage controller; 80-source driving integrated circuit; 90-frame buffer; and 100-transmitter.

DETAILED DESCRIPTION OF THE PREFERRED EMBODIMENTS

Figure 1:
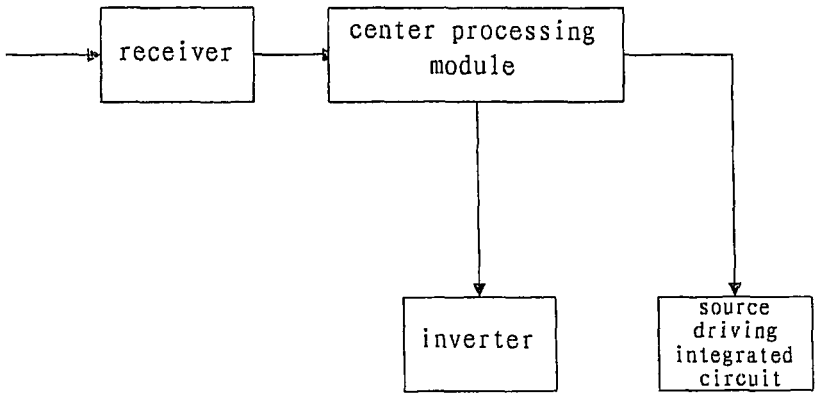
FIG. 1 is a structurally schematic diagram of a processing device for high dynamic contrast of a LCD of the present invention.

FIG. 1 is a structurally schematic diagram of a processing device for high dynamic contrast of a LCD of the present invention. The processing device for high dynamic contrast of the LCD comprises a receiver, an inverter and a source driver integrated circuit connected to a center processing module, respectively. The receiver receives a low voltage differential signaling data. The center processing module performs a histogram-statistical processing on the received data, obtains a backlight source luminance control parameter and a gamma reference voltage parameter for the same frame according to the result of the histogram-statistical processing, and generates a pulse-width-modulation dimming control signal and a group of gamma reference voltages. The inverter and the source driving integrated circuit act as execution mechanisms. The inverter receives the pulse-width-modulation dimming control signal from the center processing module, and drives a backlight source to control its luminance. The source driver integrated circuit receives the gamma reference voltages from the center processing module, and drives a liquid crystal panel to control a voltage applied to the pixel capacitor on the liquid crystal panel and keep the luminance of the liquid crystal panel unchanged before and after changes of the backlight source luminance by varying the transmittance ratio of pixel points on the liquid crystal panel.

The above technical solution of the present invention reduces the luminance of picture by decreasing the luminance of the backlight source, varies the transmittance ratio of the liquid crystal panel by adjusting the driving voltages of the pixel points on the liquid crystal panel, and compensates for distortion due to reduction of the backlight source luminance with the transmittance ratio. Specifically, the present invention performs histogram-statistical processing on the input LVDS data, and concurrently adjusts the luminance of the backlight source and the gamma reference voltages of the liquid crystal panel according to result of the processing, thereby increasing the dynamic contrast of pictures and improving the TFT LCDs in terms of low contrast. Since the luminance of the liquid crystal panel is kept unchanged with changes of the backlight source luminance, problems about flicker is removed. Meanwhile, as the luminance of the backlight source is adjusted by way of external pulse-width-modulation dimming, power consumption of the backlight source is reduced.

Figure 2:
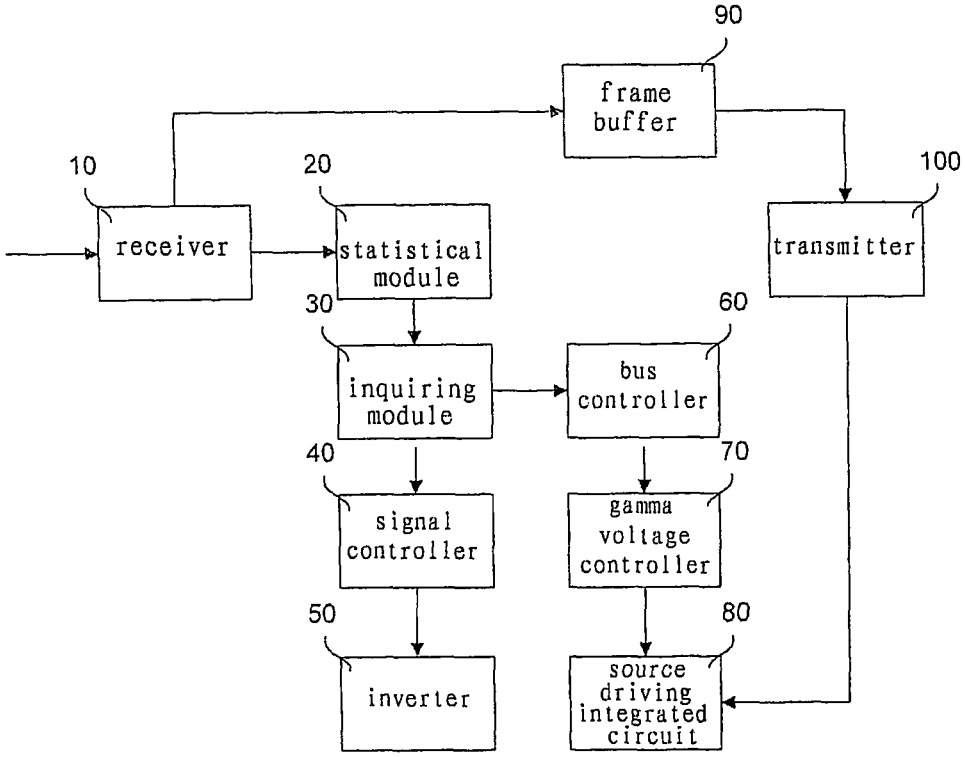
FIG. 2 is a structurally schematic diagram of an embodiment of the present invention.

FIG. 2 is a structural diagram of an embodiment of the present invention. In the embodiment, there is included a receiver 10, a statistical module 20, an look-up module 30, a signal controller 40 and an inverter 50 sequentially connected in series, and there is further included a bus controller 60, a gamma voltage controller 70 and a source driver integrated circuit 80 sequentially connected in series. The look-up module 30 is connected to the bus controller 60. The receiver 10 receives an input LVDS data and converts its format. The statistical module 20 receives the format-converted data from the receiver 10, and performs a histogram-statistical processing on it. The look-up module 30 receives the result of the histogram-statistical processing from the statistical module 20, and obtains a backlight source luminance control parameter and a gamma reference voltage parameter for the same frame according to the result of the statistics. The signal generator 40 receives the backlight source luminance control parameter from the look-up module 30, and generates a pulse-width-modulation dimming control signal. The inverter 50 receives the pulse-width-modulation dimming control signal from the signal controller 40, and drives the backlight source to vary its luminance according to this pulse-width-modulation dimming control signal. At the same time, the bus controller 60 receives the gamma reference voltage parameter from the look-up module 30, and converts it into a bus format. The gamma voltage controller 70 receives the gamma reference voltage parameter in the bus format from the bus controller 60, and generates a group of gamma reference voltages. The source driver integrated circuit 80 receives the gamma reference voltages from the gamma voltage controller 70, and drives the liquid crystal panel according to the gamma reference voltages so as to control the voltage applied to the pixel capacitor in each pixel point on the liquid crystal panel to vary the transmittance ratio of each pixel point on the liquid crystal panel. Thus, the luminance of pixels of which gray levels are of dominant distribution on the liquid crystal panel is kept unchanged with changes of the backlight source luminance.

Luminance of the cold cathode fluorescent lamp (CCFL) backlight source is directly dependent on the lamp current in the CCFL lamp. The driving of the lamp current is performed by an inverter converting DC to AC. Digital manner for luminance adjusting of the inverter is also referred to as pulse width modulation (PWM). The luminance of the backlight source is controlled by adjusting the duty ratio of a PWM dimming signal. As the duty ratio of the PWM dimming signal increases, the time period in which the backlight source is in an on state in one dimming cycle will be longer and therefore the luminance of the backlight source will be higher. Since the backlight source is continuously in an alternative state of on and off under such an adjusting manner, a PWM signal with higher frequency than that of a refresh ratio, typically between 120 Hz-240 Hz, is used to control the on and off state of the backlight source, and thus the human eyes will not perceive the flicker of the backlight source.

The statistical module 20 of the present embodiment specifically performs the histogram statistics on the input data as follows: the histogram statistics is to take statistics on luminance of each point on a frame in terms of gray level, and distribution of each gray level may be obtained from the statistical result. For example, the resolution of a display is XGA (1024*768), so an entire frame of picture has 1024×768=786432 pixel points, each of which has its corresponding luminance (i.e. a gray level). Thus, the statistics may be taken on all the pixel points based on the gray levels, and the statistical result is the amount of pixel points in the frame of picture occupied by each gray level. A threshold is set on the histogram. If a statistical amount of a certain gray level exceeds this threshold, then the gray level has a greater distribution in the frame of picture, and the processing performed on its details should be enhanced, or it is at least ensured that its details are not lost. Likewise, if a statistical amount of a certain gray level is below this threshold, then this gray level has a smaller distribution in the frame of picture, and the processing performed on its details should be weakened.

Dimming coefficient β may be determined based on the above statistical process. For example, if the count of high gray level is low in the statistical result, that is, the whole frame of picture is relatively dark, the dimming coefficient may be decreased to ensure that the details of at least middle and low gray levels with greater distributions are not lost.

Figure 3:
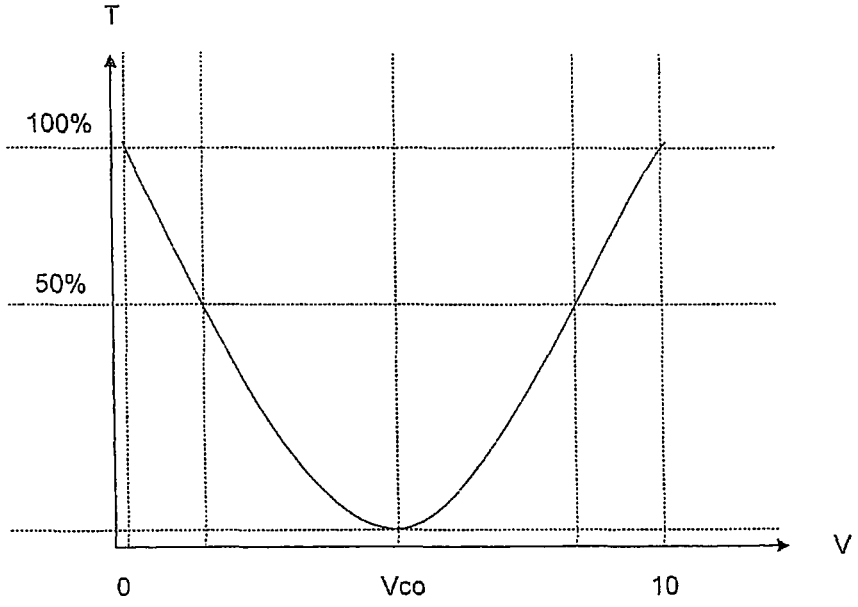
FIG. 3 is a graph of V-T curve of a transmittance ratio of a pixel point on a liquid crystal panel with respect to a pixel capacitor voltage on this pixel point.

FIG. 3 is a graph of V-T curve of a transmittance ratio of a pixel point on a liquid crystal panel with respect to a pixel capacitor voltage on this pixel point, and it reflects the relationship between the transmittance ratio of the pixel point on the TFT liquid crystal panel and the voltage applied to the pixel capacitor of this pixel point, and reflects directly a basic displaying characteristic of the TFT liquid crystal panel. For a TFT liquid crystal panel in a normally-black mode, when the luminance of the backlight source remains unchanged, its V-T curve is as shown in FIG. 3, where the abscissa represents the pixel capacitor voltage V, and the ordinate represents the transmittance ratio T of the pixel point on the liquid crystal panel.

Figure 4:
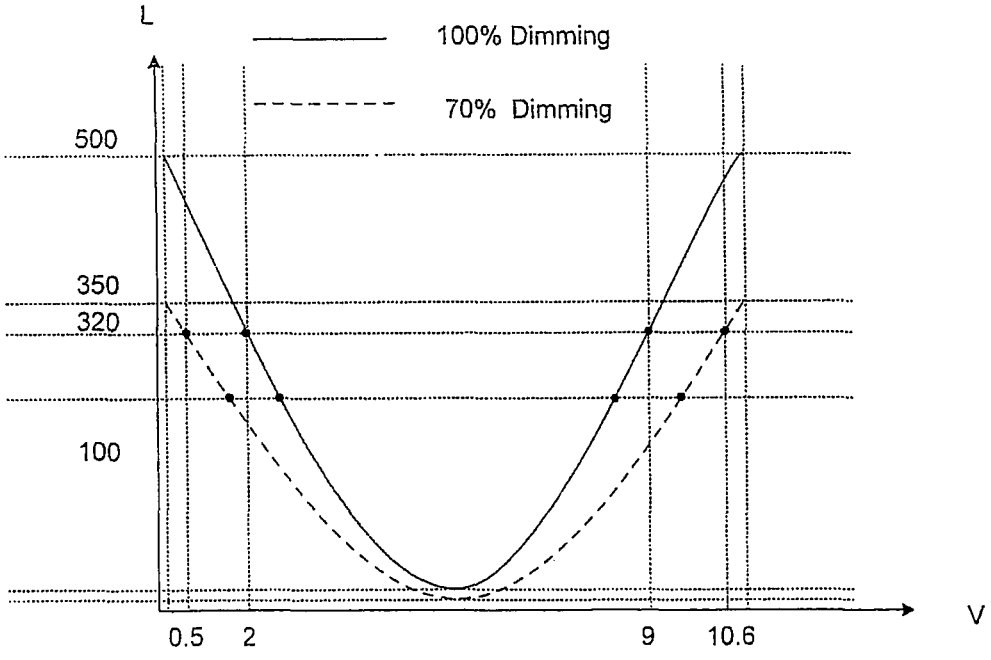
FIG. 4 is a graph of L-V curve of a luminance of a pixel point on a liquid crystal panel with respect to a pixel capacitor voltage on this pixel point.

FIG. 4 is a graph of L-V curve of a luminance of a pixel point on a liquid crystal panel with respect to a pixel capacitor voltage on this pixel point. The displaying luminance on a liquid crystal panel may be expressed as:

$$L=B(\beta)\times T(V),$$

where L represents the luminance of a pixel point on the liquid crystal panel, B is the luminance of the backlight source, and it is a function of the dimming coefficient β, and T represents the transmittance ratio of the pixel point of the liquid crystal panel, and it is a function of the pixel capacitor voltage V.

According to the above equation, a relationship between the luminance L of the liquid crystal panel and the pixel capacitor voltage V, which is referred to as L-V curve. The luminance B of the backlight source is proportional to the dimming coefficient β. When the dimming coefficient β equals to 100%, the luminance of the backlight source is the greatest. The luminance of the backlight source will decrease as the dimming coefficient β decreases. Thus, different L-V curves may be plotted with different dimming coefficients β according to the above equation, as shown in FIG. 4. When the dimming coefficient β=100%, the greatest luminance of the liquid crystal panel is 500 nit; when β=70%, the greatest luminance of the liquid crystal panel is 350 nit. For a point with the luminance of the liquid crystal panel being 320 nit, corresponding points may be found in the two curves of β=100% and β=70% with different pixel capacitor voltages V corresponding hereto. For different dimming coefficients β1 and β2, if the luminance of the pixel point on the liquid crystal panel is required to be identical, the relationship of the corresponding pixel capacitor voltage V may be obtained from the above equation:

$$B(\beta_1)\times T(V_1)=B(\beta_2)\times T(V_2),$$

where $V_1$ represents the pixel capacitor voltage corresponding to the dimming coefficient $\beta_1$. $T(V_1)$ is the transmittance ratio of the pixel point on the liquid crystal panel, which corresponds to the pixel capacitor voltage $V_1$. $V_2$ represents the pixel capacitor voltage corresponding to the dimming coefficient $\beta_2$, and $T(V_2)$ is the transmittance ratio of the pixel point on the liquid crystal panel, which corresponds to the pixel capacitor voltage $V_2$. Thus, the dimming coefficient β may be decreased in a certain range. By adjusting the pixel capacitor voltage V to vary the transmittance ratio T of the pixel point on the liquid crystal panel, the luminance output from the pixel point on the liquid crystal panel is kept unchanged.

The present invention produces a series of curves about the correspondences of the backlight source luminance and gamma reference voltages based on the V-T curves in combination with backlight source control, and produces different L-V curves with different duty ratio of the PWM dimming signal, thereby sets up the relationship of the gamma reference voltages at the same luminance under the condition of different PWM dimming duty ratio.

The process of setting up the correspondence between the backlight source luminance and the gamma reference voltage comprises: adjusting the above equation as $B(\beta_1)\times T(V'_1)=B(\beta_2)\times T(V'_2)$, where $V'_1$ represents the gamma voltage corresponding to the dimming coefficient $\beta_1$, and $V'_2$ is the gamma voltage corresponding to the dimming coefficient $\beta_2$. The gamma voltage $V'_1$ is a reference point of the pixel capacitor voltage V which is produced by subjecting the gamma voltage to division by resisters in the source driver integrated circuit. Assumed the dimming coefficient $\beta_1$ always equals to the maximum value of the backlight adjusting coefficient (the duty ratio is 100%), and $V'_1$ equals to the gamma voltage to which this dimming coefficient $\beta_1$ corresponds, then the left side of the equation is determined. When histogram statistics for a frame of picture is completed, the backlight coefficient $\beta_2$ can be obtained from the result of the histogram statistics. Thus the gamma voltage $V'_2$ corresponding to the state of the dimming coefficient $\beta_2$ can be calculated from the equation. With this process, the voltages corresponding to all the dimming coefficients are calculated and stored in a look-up table. In the operation of the system, when it is detected that a certain dimming coefficient is output, the voltage corresponding to the dimming coefficient is read out at the same time from the lookup table and the process of looking up is completed.

From the above analysis, the look-up module 30 of the present embodiment is actually of a table structure which reflects the correspondence between the backlight source luminance and the gamma reference voltage. Specifically, the main structure of the look-up module 30 is a storage unit with a lookup table stored therein, which cooperates with a corresponding addresser. After the statistical module 20 performs the histogram-statistical processing on the input data, a gray level distribution parameter of a frame of picture will be obtained. The look-up module 30 can find the backlight source luminance parameter and the gamma reference voltage parameter by searching in the lookup table the relationship between the curves stored therein according to the obtained result of the histogram-statistical processing.

In the above technical solution of the present invention, the signal controller 40 is actually a PWM dimming signal controller for controlling the luminance of the backlight source by adjusting the duty ratio of the output PWM dimming control signal. The bus controller 60 is an $I^2C$ bus controller for converting the format of the gamma reference voltage parameter. The gamma voltage controller 70 is a programmable gamma voltage controller for converting the gamma reference voltage parameter into corresponding gamma reference voltage. Based on the above technical solution, the embodiment of the present invention further includes a frame buffer 90 and a transmitter 100 connected in series between the receiver 10 and the source driver integrated circuit 80. The frame buffer 90 may be made up of SDRAM or DDR SDRAM, and receives and stores data input from the receiver 10. The transmitter 100 reads the data from the frame buffer 90, and sends the same to the source driver integrated circuit 80. Since operations such as histogram statistics and look-up are required to perform on the input LVDS data in the present invention, the frame buffer 90 functions as a means for temporarily storing the data, and after the operations of the present invention are completed, the liquid crystal panel carries out the displaying processing.

In the work process of the processing device for the high dynamic contrast of the LCDs of the present invention, firstly, the receiver 10 receives the input LVDS data and converts its format, then outputs to the frame buffer 90 for storing. The receiver 10 converts the format of the LVDS data from series bus to parallel bus, then the statistical module 20 performs the histogram-statistical processing on the converted data. The look-up module 30 searches the table structure according to the result of the statistical processing, obtains the corresponding backlight source luminance control parameter and gamma reference voltage parameter, transfers the backlight source luminance control parameter to the signal controller 40, and transfers the gamma reference voltage parameter of the same frame of picture to the bus controller 60. The signal controller 40 generates the PWM dimming control signal, and sends it to the inverter 50 for driving the backlight source. The bus controller 60 converts the gamma reference voltage parameter into the bus format, and transfers the same to the programmable gamma voltage controller 70. The gamma voltage controller 70 generates the corresponding gamma reference voltage to be transferred to the source driver integrated circuit 80. At the same time, the transmitter 100 reads out the data stored in the frame buffer 90, and sends the read data to the source driver integrated circuit 80. Thus, the synchronous conversion of the backlight source luminance and the gamma reference voltage is completed.

Therefore, since the backlight source is controlled continuously by the PWM dimming signal output from the signal controller 40, and it is in a successively alternative state between on and off state, a part of power is saved. Especially in the case where the displayed picture is mostly in the dark state, more power can be saved. The power consumption of the backlight source occupies over 40% of that in the entire LCD device. Such adjusting solution for backlight source luminance of the present invention saves the power consumed by the backlight source, and reduces that of the final product.

Figure 5:
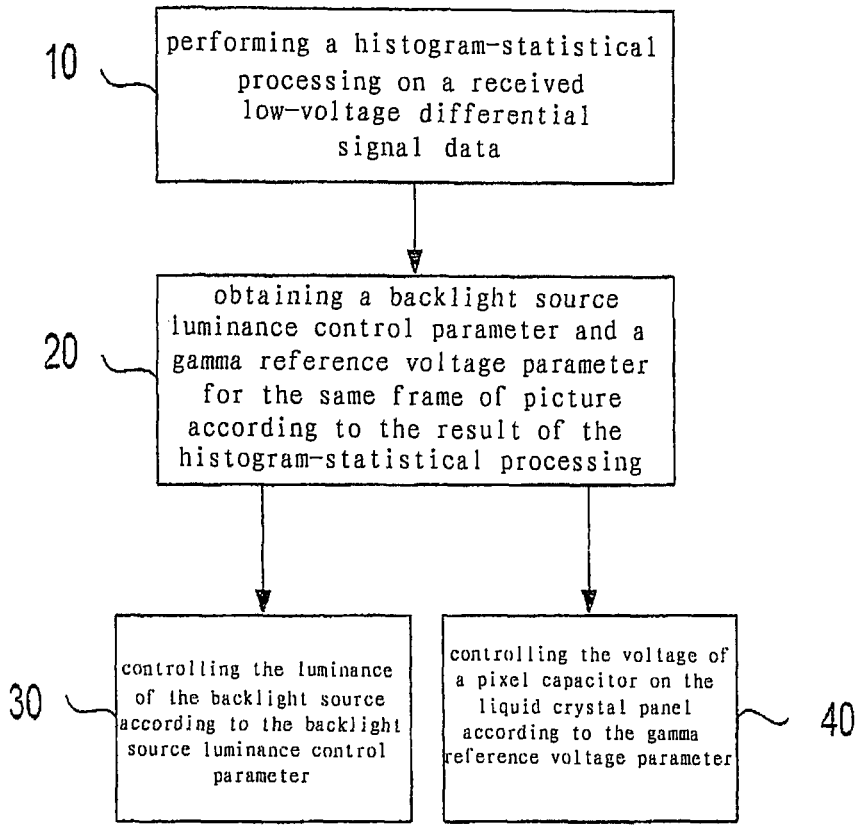
FIG. 5 is a flowchart of a processing method for high dynamic contrast of the LCD of the present invention.

FIG. 5 is a flowchart of a processing method for the high dynamic contrast of the LCD of the present invention, which includes in particular: the step 10 of performing a histogram-statistical processing on a received low voltage differential signaling data; the step 20 of obtaining a backlight source luminance control parameter and a group of gamma reference voltages parameter for the same frame of picture according to the result of the histogram-statistical processing; the step 30 of controlling the luminance of the backlight source according to the backlight source luminance control parameter; and the step 40 of controlling the voltage of a pixel capacitor on the liquid crystal panel according to the gamma reference voltage parameter.

The above technical solution of the present invention decreases the luminance of a picture by decreasing the luminance of the backlight source, varies the transmittance ratio of the liquid crystal panel by adjusting the voltages of the pixel capacitors on the liquid crystal panel, and compensates for distortion due to the decreasing of the backlight source luminance with the transmittance ratio. Specifically, the present invention performs histogram-statistical processing on the input data, and concurrently adjusts the luminance of the backlight source and the gamma reference voltage of the liquid crystal panel according to the result of the processing, thereby increasing the dynamic contrast of pictures and improving the TFT LCDs in terms of low contrast. Since the luminance of the pixel points which are of prominent on the liquid crystal panel is kept unchanged with changes of the backlight source luminance, problems about flicker is removed. Meanwhile, as the luminance of the backlight source is adjusted by way of external pulse-width-modulation dimming, the power consumption of the backlight source is reduced.

The step 10 comprises specifically the step of obtaining an amount of pixel points occupied by each gray level in a frame of picture; the step of determining the gray level which has the greatest distribution in the frame according to a threshold; and the step of determining the dimming coefficient according to the gray level which has the greatest distribution.

The embodiment of the present invention firstly takes statistics on all the pixel points by using the histogram statistics based on the gray levels, obtains the amount of pixel points occupied by each gray level in the frame of picture, obtains a distribution of each gray level in the frame by comparison with the threshold, and determines the dimming coefficient according to the gray level with the greatest distribution, in a condition that it is ensured the details of the middle and low gray levels with more distribution are not lost.

The step 20 comprises specifically the step of determining the backlight source luminance control parameter according to said dimming coefficient; the step of determining a corresponding gamma voltage according to said dimming coefficient; and the step of obtaining a gamma voltage parameter corresponding to the gamma voltage from a lookup table according to the gamma voltage.

Once the dimming coefficient is determined, the backlight source luminance parameter and the gamma reference voltage parameter can be found by searching in the lookup table the correspondence between the curves stored therein. Herein, the backlight source luminance control parameter is just the duty ratio of the PWM dimming signal.

The step 30 comprises specifically the step of generating a pulse-width-modulation dimming control signal from the backlight source luminance control parameter; and the step of driving the backlight source by using the pulse-width-modulation dimming control signal.

The pulse-width-modulation dimming control signal is generated from the backlight source luminance parameter and then used to drive the backlight source so as to change the luminance of the backlight source.

The step 40 comprises specifically the step of converting the gamma reference voltage parameter into a bus format; the step of generating a group of gamma reference voltages from the gamma reference voltage parameter in the bus format; and the step of driving the liquid crystal panel by using the gamma reference voltages.

The gamma reference voltage parameter is converted into the bus format to therefore generate the gamma reference voltages for driving the liquid crystal panel, varying the transmittance ratio of the liquid crystal panel, and thus keeping the luminance of pixel points of which the gray levels have dominant distribution on the liquid crystal panel unchanged with changes of the luminance of the backlight source.

The above technical solution of the present invention dramatically improves the dynamic contrast and quality of pictures in the premise of keeping the luminance of the liquid crystal panel unchanged, decreases the luminance of pictures by decreasing the luminance of the backlight source, varies the transmittance ratio of the liquid crystal panel by adjusting the voltages of the pixel capacitor on the liquid crystal panel, and compensates for distortion due to the reduction of the backlight source luminance with the transmittance ratio. Specifically, the processing method for the high dynamic contrast of the liquid crystal display device of the present invention performs histogram-statistical processing on the input data, and concurrently adjusts the luminance of the backlight source and the gamma reference voltage of the liquid crystal panel according to the result of the processing, thereby increasing the dynamic contrast of pictures and improving the TFT LCDs in terms of low contrast. Since in the technical solution of the processing method for the high dynamic contrast of the liquid crystal display device of the present invention, the luminance of the liquid crystal panel is kept unchanged with changes of the backlight source luminance, problems about flicker is removed. Meanwhile, as the luminance of the backlight source is adjusted by way of external pulse-width-modulation dimming, the power consumption of the backlight source is reduced.

It should be noted that the above embodiments are only used for describing the technical solution of the present invention but not for limitation. Although the present invention is described in details with reference to the preferred embodiments, it will be appreciated for those skilled in the art that the embodiments of the present invention can be modified and/or changed equivalently without departing from the scope or spirit of the present invention.

What is claimed is:

1. A processing device for a high dynamic contrast of a liquid crystal display, in comprising:

a receiver for receiving a low-voltage differential signal data;

a center processing module for performing a histogram-statistical processing on said low-voltage differential signal data, obtaining a backlight source luminance control parameter and a gamma reference voltage parameter for the same frame of picture according to the result of the statistical processing, and generating a pulse-width-modulation dimming control signal and a group of gamma reference voltages;

an inverter for receiving the pulse-width-modulation dimming signal from said center processing module and adjusting the luminance of the backlight source by adjusting a duty ratio of the pulse-width-modulation dimming control signal; and a source driver integrated circuit for receiving the gamma reference voltage from said center processing module and driving a liquid crystal panel, whereby the voltage of a pixel capacitor on the liquid crystal panel is adjusted synchronously with the adjusting of the luminance of the backlight source, according to the gamma reference voltage parameter, and thus the transmittance ratio of the pixel points on the liquid crystal pane is changed such that the luminance of the liquid crystal panel is kept unchanged after the luminance of the backlight source varies.

2. The processing device for the high dynamic contrast of the liquid crystal display of claim 1, wherein said center processing module comprises:

a statistical module for receiving the data from said receiver and performing the histogram-statistical processing on said data;

a look-up module for receiving the result of the histogram-statistical processing from said statistical module, and obtaining the backlight source luminance control parameter and the gamma reference voltage parameter for the same frame of picture according to the result of the statistical processing;

a signal controller for receiving the backlight source luminance control parameter from said look-up module and generating the pulse-width-modulation dimming control signal to be sent to said inverter;

a bus controller for receiving the gamma reference voltage parameter from said look-up module and converting it into a bus format; and a gamma voltage controller for receiving the format-converted gamma reference voltage parameter from said bus controller, and generating the gamma reference voltages to be sent to said source driver integrated circuit.

3. The processing device for the high dynamic contrast of the liquid crystal display of claim 2, wherein said look-up module comprises a storage unit storing a lookup table therein which records correspondence of the backlight source luminance and the gamma reference voltage.

4. The processing device for the high dynamic contrast of the liquid crystal display of claim 1, further comprising:

a frame buffer for receiving and storing the low-voltage differential signal subjected to a format-conversion by said receiver; and a transmitter for reading data from said frame buffer and sending the data to the source driver integrated circuit.

5. A processing method for a high dynamic contrast of a liquid crystal display comprising:

a receiver for receiving a low-voltage differential signal data;

a center processing module for performing a histogram-statistical processing on said low-voltage differential signal data, obtaining a backlight source luminance control parameter and a gamma reference voltage parameter for the same frame of picture according to the result of the statistical processing, and generating a pulse-width-modulation dimming control signal and a group of gamma reference voltages;

an inverter for receiving the pulse-width-modulation dimming signal from said center processing module and adjusting the luminance of the backlight source by adjusting a duty ratio of the pulse-width-modulation dimming control signal; and a source driver integrated circuit for receiving the gamma reference voltage from said center processing module and driving a liquid crystal panel;

the method comprising the following steps:

performing a histogram-statistical processing on the received low-voltage differential signal data;

obtaining a backlight source luminance control parameter and a gamma reference voltage parameter for the same frame of picture according to the result of the histogram-statistical processing;

controlling the luminance of the backlight source according to said backlight source luminance control parameter; and controlling the voltage of a pixel capacitor on the liquid crystal panel according to said gamma reference voltage parameter, whereby the voltage of a pixel capacitor on the liquid crystal panel is adjusted synchronously with the adjusting of the luminance of the backlight source, according to the gamma reference voltage parameter, and thus the transmittance ratio of the pixel points on the liquid crystal pane is changed such that the luminance of the liquid crystal panel is kept unchanged after the luminance of the backlight source varies.

6. The processing method for the high dynamic contrast of the liquid crystal display of claim 5, wherein said performing of a histogram-statistical processing on the received low-voltage differential signal data comprises:

obtaining an amount of pixel points occupied by each gray level in one frame of picture;

determining the gray level which has the greater distribution in the frame of picture according to a threshold; and determining a dimming coefficient according to said gray level which has the greater distribution.

7. The processing method for the high dynamic contrast of the liquid crystal display of claim 5, wherein said obtaining of the backlight source luminance control parameter and the gamma reference voltage parameter of the same frame of picture according to the result of the histogram-statistical processing comprises:

determining the backlight source luminance control parameter according to the result of the histogram-statistical processing;

determining a corresponding gamma voltage according to said dimming coefficient; and obtaining a gamma voltage parameter corresponding to said gamma voltage from a lookup table based on said gamma voltage.

8. The processing method for the high dynamic contrast of the liquid crystal display of claim 5, wherein said controlling of the luminance of the backlight source according to said backlight source luminance control parameter comprises:

generating a pulse-width-modulation dimming control signal from said backlight source luminance control parameter; and driving the backlight source by using said pulse-width-modulation dimming control signal.

9. The processing method for the high dynamic contrast of the liquid crystal display of claim 5, wherein said controlling of the voltage of the pixel capacitor on the liquid crystal panel according to said gamma reference voltage parameter comprises:

converting said gamma reference voltage parameter into a bus format;

generating a group of gamma reference voltages from the gamma reference voltage parameter in the bus format; and driving the liquid crystal panel by using said gamma reference voltage.

10. The processing method for the high dynamic contrast of the liquid crystal display of claim 5, further comprising:

buffering the received low-voltage differential signal data; and sending said low-voltage differential signal data to the liquid crystal panel.

* * * * *